US005440954A

United States Patent [19]

Stevens

[11] Patent Number: 5,440,954

[45] Date of Patent: Aug. 15, 1995

[54] DEVICE FOR UNLOCKING VEHICLE DOORS WITHOUT THE USE OF A KEY

[76] Inventor: Randy D. Stevens, P.O. Box 114, Flagler, Colo. 80815

[21] Appl. No.: 254,692

[22] Filed: Jun. 6, 1994

[51] Int. Cl.[6] ..... B25B 33/00

[52] U.S. Cl. ..... 81/15.9; 81/488

[58] Field of Search ..... 81/488, 15.9, 177.1, 81/177.2; 157/1.3; 29/267, 278; 254/120, 131

[56] References Cited

U.S. PATENT DOCUMENTS 4,433,462 2/1984 Stratton ..... 29/267 X
4,683,783 8/1987 Fanberg ..... 81/15.9
4,882,954 11/1989 Selby ..... 81/15.9

FOREIGN PATENT DOCUMENTS 649570 8/1937 Germany ..... 254/131

*Primary Examiner*—D. S. Meislin

[57] ABSTRACT

A device for unlocking vehicle doors without the use of a key comprising a device formed of a rigid material in a generally L-shaped configuration having a long component and a short component at right angles with respect to the long component; the long component having an upper extent and a lower extent, with a transition piece therebetween, the transition piece having a twist with respect to the upper and lower extent; and the short component being shorter than the long component and formed with a linear upper edge and a lower edge linear from its junction with the long component, the lower surface of the short component having a recess formed with a right angle perpendicular to the lower surface adjacent to the outboard end.

3 Claims, 4 Drawing Sheets

DEVICE FOR UNLOCKING VEHICLE DOORS WITHOUT THE USE OF A KEY

BACKGROUND OF THE INVENTION

1. Field of the Invention

The present invention relates to a device for unlocking vehicle doors without the use of a key and more particularly pertains to unlocking doors of late model Chevrolet and GMC trucks through the use of a specially configured lockout tool.

2. Description of the Prior Art

The use of lockout tools of various sizes, shapes and constructions is known in the prior art. More specifically, lockout tools of various sizes, shapes and constructions heretofore devised and utilized for the purpose of unlocking vehicles with specially configured tools are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,622,868 a tool used to manually lock and unlock a passenger door of a motor vehicle.

U.S. Pat. No. 4,655,102 discloses a locksmith tool for unlocking motor vehicle doors.

U.S. Pat. No. 4,706,525 discloses a vehicle door unlocking device.

U.S. Pat. No. 4,882,954 discloses an unlocking device for vehicle doors.

U.S. Pat. No. 5,104,094 discloses a car door latch mechanism viewing tool.

In this respect, the device for unlocking vehicle doors without the use of a key according to the present invention substantially departs from the conventional concepts and designs of the prior art, and in doing so provides an apparatus primarily developed for the purpose of unlocking doors of late model Chevrolet and GMC trucks through the use of a specially configured lockout tool.

Therefore, it can be appreciated that there exists a continuing need for a new and improved device for unlocking vehicle doors without the use of a key which can be used for unlocking doors of late model Chevrolet and GMC trucks through the use of a specially configured lockout tool. In this regard, the present invention substantially fulfills this need.

SUMMARY OF THE INVENTION

In view of the foregoing disadvantages inherent in the known types of lockout tools of various sizes, shapes and constructions now present in the prior art, the present invention provides an improved device for unlocking vehicle doors without the use of a key. As such, the general purpose of the present invention, which will be described subsequently in greater detail, is to provide a new and improved device for unlocking vehicle doors without the use of a key and method which has all the advantages of the prior art and none of the disadvantages.

To attain this, the present invention essentially comprises a new and improved device for unlocking vehicle doors without the use of a key comprising, in combination, a device formed of a rigid material in a generally L-shaped configuration having a long component and a short component at right angles with respect to the long component; the long component having an upper extent and a lower extent, the upper extent being longer than the lower extent and parallel to each other with a transition piece therebetween, the transition piece having a twist with respect to the upper and lower extent, the transition piece being of a shorter length than either the upper or lower extent; and the short component being shorter than the long component and formed with a linear upper edge and a lower edge linear for a minor portion of its extent from its junction with the long component, the lower surface of the short component having a recess formed with a right angle perpendicular to the lower surface adjacent to the outboard end, a linear extent within the recess parallel with the upper edge over the majority of its extent and an angled portion extending downwardly and coupling with the inboard section of the lower surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for unlocking vehicle doors without the use of a key which has all the advantages of the prior art lockout tools of various sizes, shapes and constructions and none of the disadvantages.

It is another object of the present invention to provide a new and improved device for unlocking vehicle doors without the use of a key which may be easily and efficiently manufactured and marketed.

It is further object of the present invention to provide a new and improved device for unlocking vehicle doors without the use of a key which is of durable and reliable construction.

An even further object of the present invention is to provide a new and improved device for unlocking vehicle doors without the use of a key which is susceptible of a low cost of manufacture with regard to both materials and labor, and which accordingly is then susceptible of low prices of sale to the consuming public, thereby making such device for unlocking vehicle doors without the use of a key economically available to the buying public.

Still yet another object of the present invention is to provide a new and improved device for unlocking vehicle doors without the use of a key which provides in the apparatuses and methods of the prior art some of the advantages thereof, while simultaneously overcoming some of the disadvantages normally associated therewith.

Still another object of the present invention is to unlock doors of late model Chevrolet and GMC trucks through the use of a specially configured lockout tool.

Lastly, it is an object of the present invention to provide a new and improved device for unlocking vehicle doors without the use of a key comprising a device formed of a rigid material in a generally L-shaped configuration having a long component and a short component at right angles with respect to the long component; the long component having an upper extent and a lower extent, with a transition piece therebetween, the transition piece having a twist with respect to the upper and lower extent; and the short component being shorter than the long component and formed with a linear upper edge and a lower edge linear from its junction with the long component, the lower surface of the short component having a recess formed with a right angle perpendicular to the lower surface adjacent to the outboard end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
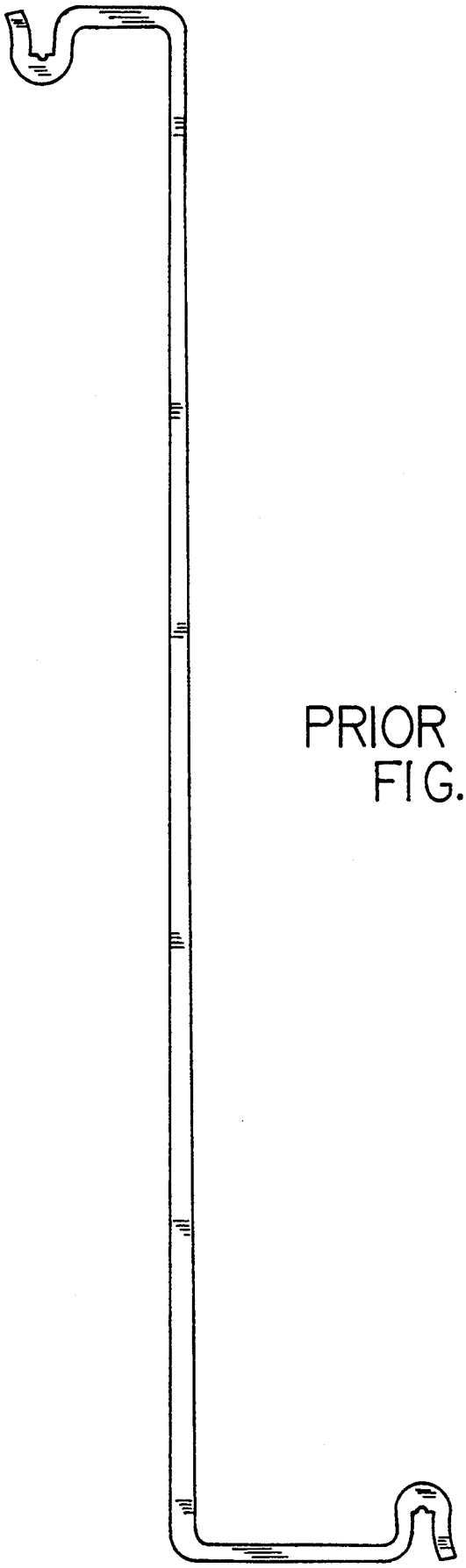
PRIOR ART FIG. 1
FIG. 1 is a front elevational view of a prior art lockout tool.
Figure 2:
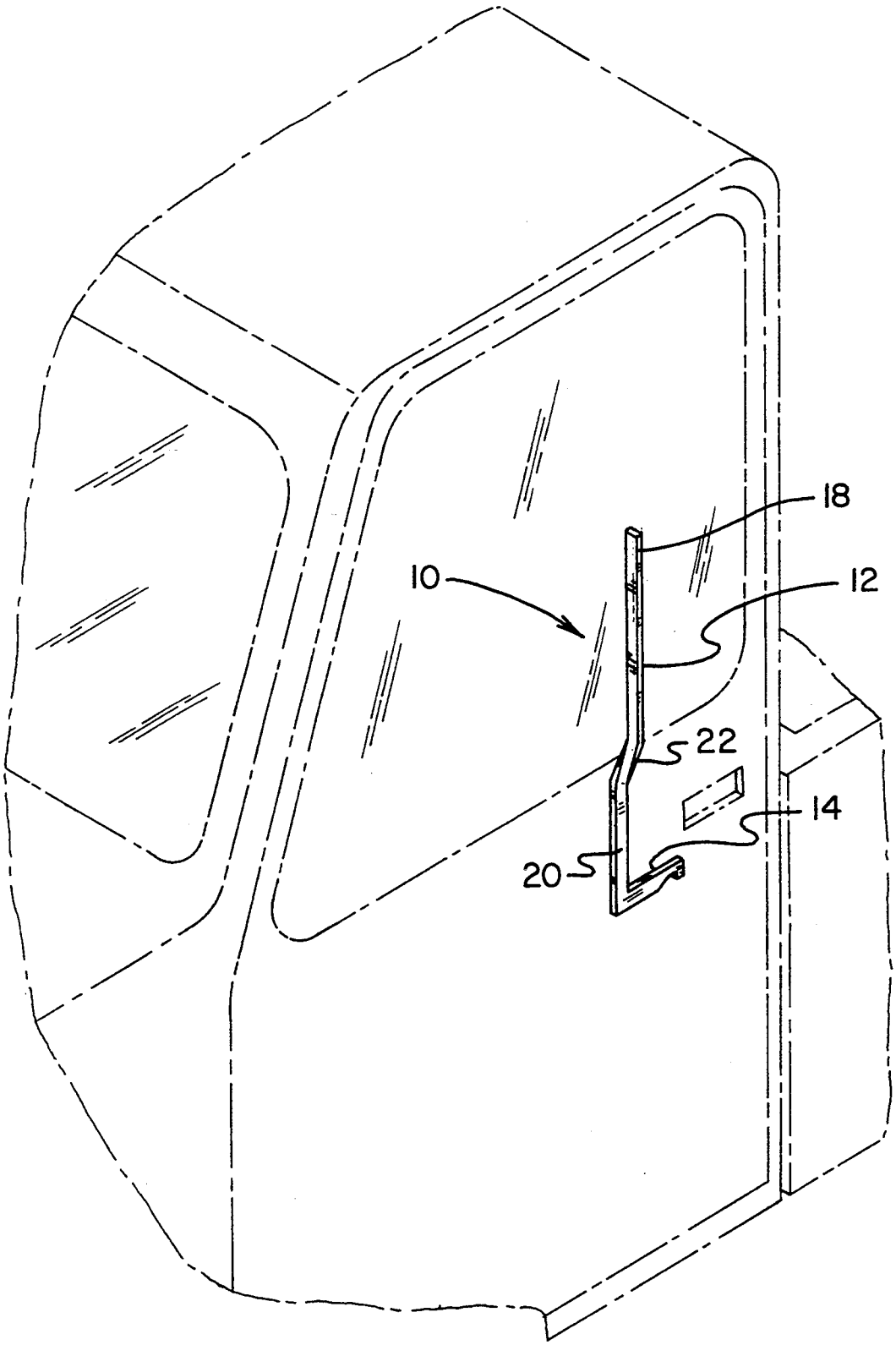
FIG. 2 is a perspective view of the preferred embodiment of the new and improved device for unlocking vehicle doors without the use of a key constructed in accordance with the principles of the present invention.
Figure 3:
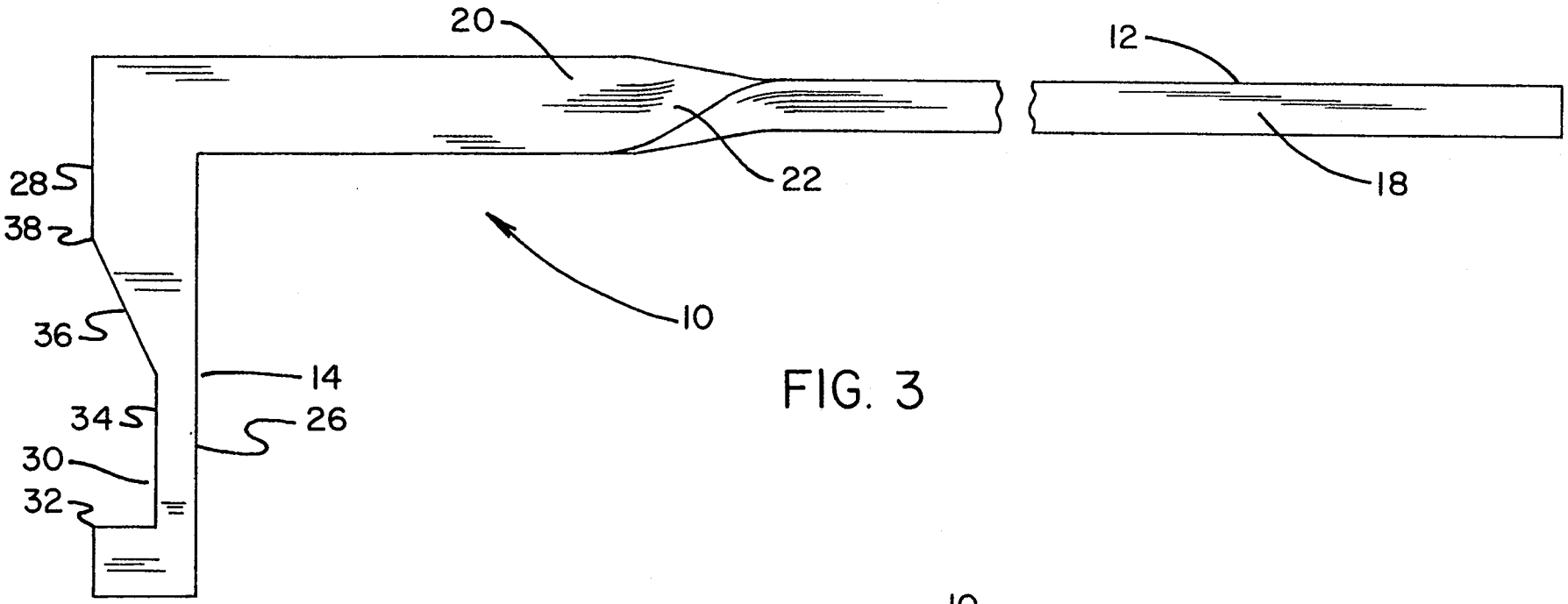
FIG. 3 is a plan view of the lockout tool shown in FIG. 2.
Figure 4:
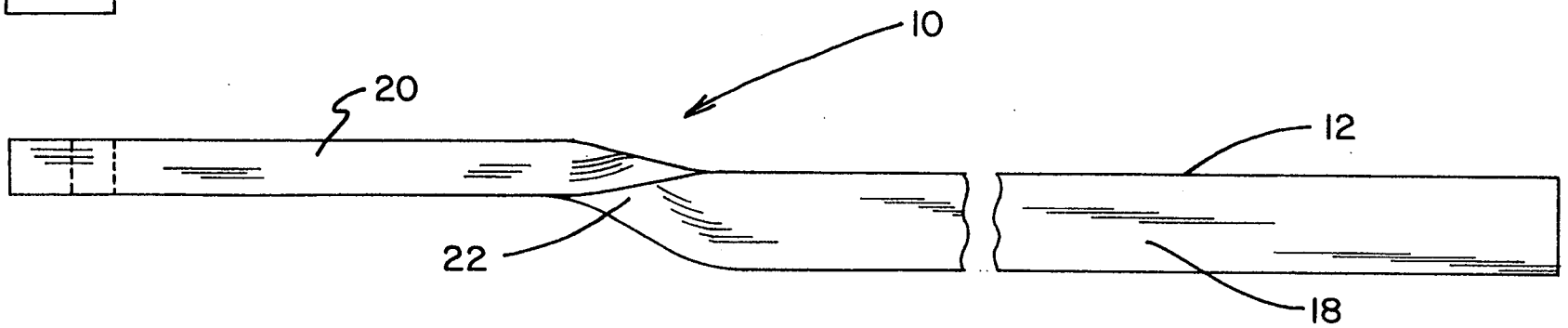
FIG. 4 is a side elevational view of the lockout tool shown in FIGS. 2 and 3.
Figure 5:
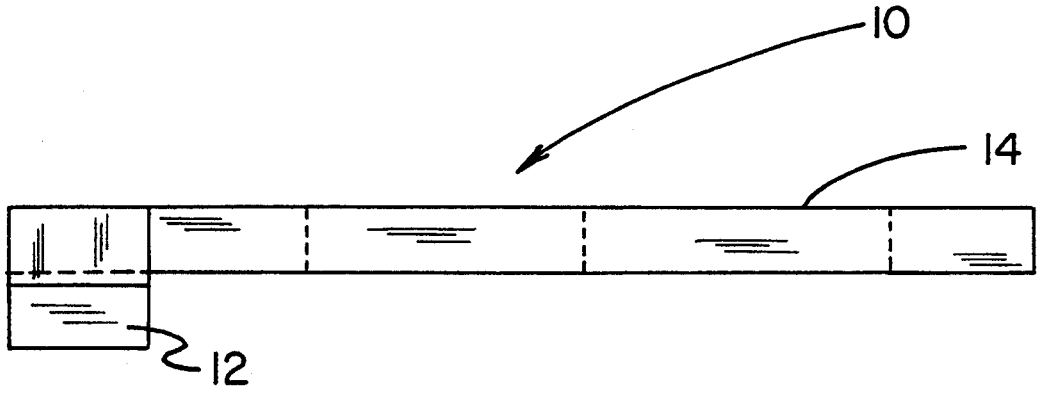
FIG. 5 is a top plan view of the lower end of the lockout tool shown in FIGS. 1, 2 and 3.
Figure 6:
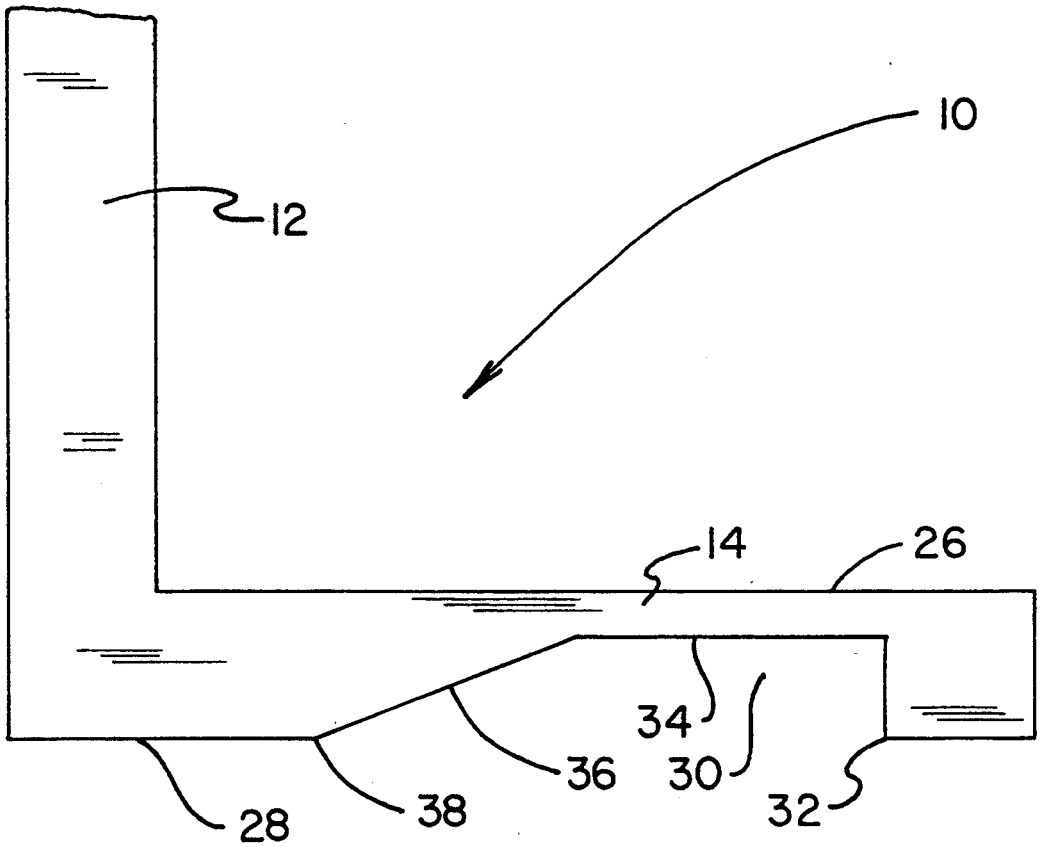
FIG. 6 is a front elevational view of the portion of the lockout tool shown in FIG. 5.

With reference now to the drawings, and in particular to FIG. 1 thereof, the preferred embodiment of the new and improved device for unlocking vehicle doors without the use of a key embodying the principles and concepts of the present invention and generally designated by the reference numeral 10 will be described.

The present invention, the new and improved device for unlocking vehicle doors without the use of a key, is comprised of a single component formed of a plurality of parts. Such parts, in their broadest context, include an L-shaped device, a long component, a short component with a recess in the lower edge of the short component. Such parts are individually configured and correlated with respect to each other so as to attain the desired objective.

More specifically, the device 10 is formed of a rigid material preferably metal. It is constructed in an L-shaped configuration. Such configuration includes a long component 12 and a short component 14. The long and short components are at right angles with respect to each other.

The long component has an upper extent 18 when positioned for operation and use. It also has a lower extent 20. The upper extent is longer than the lower extent. The upper and lower extents are parallel to each other but offset. A transition piece 22 is located between the components. The transition piece 22 is simply a twist in the metal. The transition piece is therefore a twist with respect to the upper and lower extents. The transition piece is of a shorter length than either the upper or lower extent.

The second component of the system is the short component. The short component is shorter in length than the long component. It is formed with a linear upper edge 26 and a lower edge. The lower edge is linear for a minor portion 28 of its extent. It extends from its junction with the long component. The lower surface of the short component is formed with a recess 30. The recess is formed with a right angle perpendicular to the lower surface adjacent to the outboard end 32. A linear extent 34 within the recess is located parallel with the upper edge over the majority of its extent. An angled portion 36 extends downwardly from the linear extent within the recess to appoint coupling with the inboard section 38 of the lower surface.

The present invention is a device for unlocking late model Chevrolet and GMC trucks, from 1988 to present, when a key is unavailable. People occasionally lock their trucks and cars with the keys still in the ignition or inside the vehicle. They usually having to obtain a second set of keys, or have a mechanic, locksmith, or policeman unlock the door. The tools that are currently available for this purpose are difficult to use, or simply will not unlock the doors on the aforementioned trucks. The present invention addresses this problem.

The present invention is fabricated from thin aluminum or steel that forms a narrow L-shape. The foot of the "L" features an appropriately dimensioned curved cutout or notch on its underside.

To release the locking mechanism inside the door of a truck, the device is inserted between the door's window and the outer rubber molding, above the front of the door handle. Because of its shape, the latch assembly of the inner door lock rod is easily located within the notch of the tool. By moving the tool toward the front of the truck, the lock is easily disengaged. The overall time required to perform the task with the present invention is about one minute. This can be of great significance in an emergency situation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved device for unlocking vehicle doors without the use of a key comprising, in combination:

a device formed of a rigid material in a generally L-shaped configuration having a long component and a short component at right angles with respect to the long component;

the long component having an upper extent and a lower extent, the upper extent being longer than the lower extent and parallel to each other with a transition piece therebetween, the transition piece formed as a twist with respect to the upper and lower extent, the transition piece being of a shorter length than either the upper or lower extent; and the short component being shorter than the long component and formed with a linear upper edge and a lower edge linear for a minor portion of its extent from its junction with the long component, the lower surface of the short component having a recess formed with a right angle perpendicular to the lower surface adjacent to the outboard end, a linear extent within the recess parallel with the upper edge over the majority of its extent and an angled portion extending downwardly and coupling with the inboard section of the lower surface.

2. A device for unlocking vehicle doors without the use of a key comprising:

a device formed of a rigid material in a generally L-shaped configuration having a long component and a short component at right angles with respect to the long component;

the long component having an upper extent and a lower extent, with a transition piece therebetween, the transition piece formed as a twist with respect to the upper and lower extent; and the short component being shorter than the long component and formed with a linear upper edge and a lower edge linear from its junction with the long component, the lower surface of the short component having a recess formed with a right angle perpendicular to the lower surface adjacent to the outboard end.

3. The device as set forth in claim 2 and further including:

a linear extent within the recess parallel with the upper edge over the majority of its extent and an angled portion extending downwardly and coupling with the inboard section of the lower surface.

* * * * *